US008037626B2

(12) United States Patent
Moon et al.

(10) Patent No.: US 8,037,626 B2
(45) Date of Patent: Oct. 18, 2011

(54) CLOTH TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG Electronics, Inc., Seoul (KR)

( * ) Notice: Subject to any disclaimer, the term of this patent is extended or adjusted under 35 U.S.C. 154(b) by 472 days.

(21) Appl. No.: 12/219,949

(22) Filed: Jul. 30, 2008

(65) Prior Publication Data

US 2009/0065536 A1 Mar. 12, 2009

(30) Foreign Application Priority Data

Aug. 3, 2007 (KR) ..... 10-2007-0078120

(51) Int. Cl.
*D06F 58/10* (2006.01)
*D06F 71/34* (2006.01)

(52) U.S. Cl. ..... 38/14; 68/5 C; 38/1 A

(58) Field of Classification Search ..... 223/70; 38/2, 7, 14, 1 A; 34/523, 524, 542, 543, 34/546; 68/5 C See application file for complete search history.

(56) References Cited

U.S. PATENT DOCUMENTS

| | | | | |
|---|---|---|---|---|
| 1,564,566 | A * | 12/1925 | Harris | 34/491 |
| 2,229,559 | A | 1/1941 | Fox | |
| 3,670,425 | A * | 6/1972 | Benjamin et al. | 34/542 |
| 3,707,855 | A * | 1/1973 | Buckley | 68/6 |
| 3,858,331 | A * | 1/1975 | Lord | 34/621 |
| 3,868,835 | A * | 3/1975 | Todd-Reeve | 68/20 |
| 4,761,305 | A | 8/1988 | Ochiai | |
| 5,305,484 | A * | 4/1994 | Fitzpatrick et al. | 8/149.3 |
| 2005/0016012 | A1 | 1/2005 | Yang et al. | |

FOREIGN PATENT DOCUMENTS

| | | |
|---|---|---|
| CN | 2050442 | 1/1990 |
| CN | 2091889 | 1/1992 |
| CN | 2612716 | 4/2004 |
| CN | 2777017 | 5/2006 |
| DE | 2 410 279 | 9/1974 |
| DE | 197 12 848 | 10/1998 |
| GB | 1 414 041 | 11/1975 |

* cited by examiner

*Primary Examiner* — Ismael Izaguirre
(74) *Attorney, Agent, or Firm* — McKenna Long & Aldridge LLP

(57) ABSTRACT

A cloth treating apparatus is disclosed. A cloth treating apparatus includes a cabinet comprising an accommodating space which accommodates laundry, a air supplying device which supplies hot air to the accommodating space, an opening unit which selectively opens and closes at least one hot air supply hole, the at least one hot air supply hole through which the hot air is drawn into the accommodating space and a control unit which controls the air supplying device and the opening unit.

11 Claims, 9 Drawing Sheets

CLOTH TREATING APPARATUS

This application claims the benefit of the Patent Korean Application No. 10-2007-0078120, filed on Aug. 3, 2007, which is hereby incorporated by reference as if fully set forth herein.

BACKGROUND OF THE INVENTION

1. Field of the Invention

The present invention relates to a cloth treating apparatus. More particularly, the present invention relates to a cloth treating apparatus capable of refreshing cloth efficiently.

2. Discussion of the Related Art

Generally, cloth treating apparatuses may include washers, dryers and laundry devices having a drying and washing function. Recently, due to the enhanced standard of living, refreshers that refresh clothes, cloth items and beddings (hereinafter, laundry) have been under development. Here, a refresher refreshes laundry by dry or hot air that is supplied to the laundry held therein.

In a cloth treating apparatus such as the refresher, hot air is supplied to refresh the laundry held therein, by extension, to remove a water element. In case of supplying such the hot air, there may be a problem that it is difficult to supply the hot air to the laundry properly and efficiently.

SUMMARY OF THE INVENTION

Accordingly, the present invention is directed to a cloth treating apparatus.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cloth treating apparatus includes a cabinet comprising an accommodating space which accommodates laundry; a air supplying device which supplies hot air to the accommodating space; an opening unit which selectively opens and closes at least one hot air supply hole, the at least one hot air supply hole through which the hot air is drawn into the accommodating space; a control unit which controls the air supplying device and the opening unit.

The cloth treating apparatus may further include a steam generating device which selectively supplied steam to the accommodating space.

The control unit may control the opening unit to close the hot air supply hole if the steam is sprayed into the accommodating space by the steam generating device.

The control unit may control the opening unit to open the air supplying device if the hot air is supplied to the accommodating space by the air supplying device.

The opening unit may include a movable plate having at least one opening corresponding to the hot air supply hole. The movable plate may move between an open position where the opening is in communication with the hot air supply hole and a close position where the communication between the opening and the hot air supply hole is closed.

The opening unit may include at least one rotatable plate rotatably installed at the hot air supply hole.

A rotation angle of the rotatable plate may be adjustable.

The rotatable plate may be rotated toward an inside of the accommodating space to guide a direction of the hot air drawn into the accommodating space through the hot air supply hole.

If the rotatable plate is provided in plural, the plural rotatable plates may be rotated in communication with each other.

The plural rotatable plates may rotated by a single operation bar in communication with each other.

The cloth treating apparatus may further include a fixed guide member projected toward a rear surface of the hot air supply hole to guide the hot air to the accommodating space.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
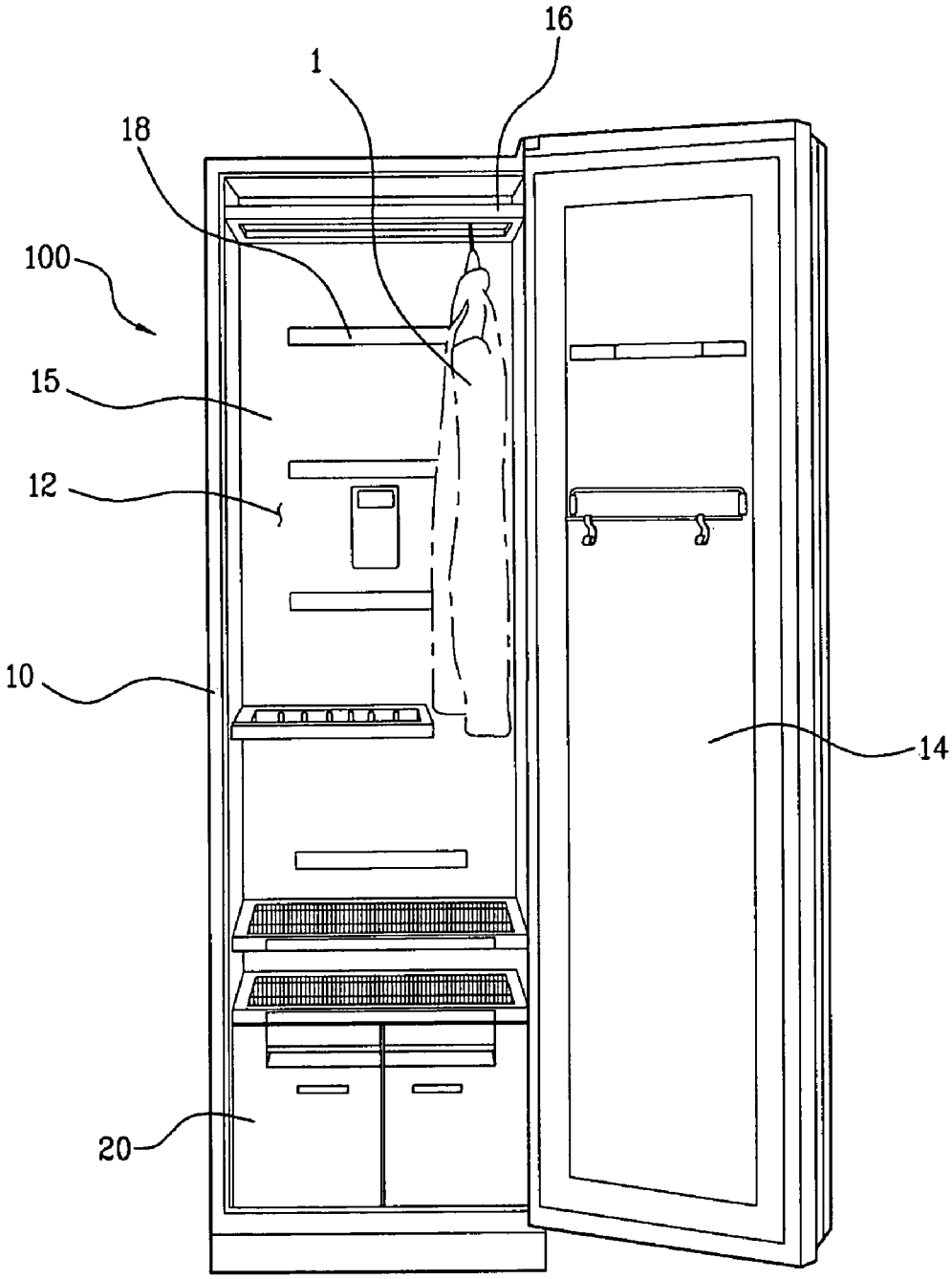
FIG. 1 is a is a front view illustrating a cloth treating apparatus according to an exemplary embodiment.

FIG. 1 is a front view illustrating a cloth treating apparatus according to an exemplary embodiment. This specification embodies a refresher that refreshes and supplies hot air to laundry as a cloth treating apparatus and it is not limited thereto. The concept of the specification may be applicable to the other kinds of cloth treating apparatuses including a heat pump that will be described later.

In reference to FIG. 1, a cloth treating apparatus 100 according to the embodiment includes a cabinet 10 having an accommodating space 12 for accommodating laundry 1, an air supplying device (22, see FIG. 2), a moisture supplying device (30, see FIG. 2) and a control unit (not shown). The air supplying device 22 supplies hot air to the accommodating space 12. The moisture supplying device 30 selectively supplies moisture into the accommodating space 12. The opening unit selectively opens and closes a hot air supply hole 18 and the air heated at the air supplying device 22 is supplied to the accommodating space 12 through the hot air supply hole 18.

The control unit (not shown) controls the moisture supplying device 30 and the opening unit.

Various kinds of elements which will be described later are provided in the cabinet 10 and the accommodating space 12 is formed in the cabinet 10 to accommodate the laundry. Such the accommodating space 12 is selectively in communication with an outside via a door 14. Various kinds of supporters 16 may be provided in the accommodating space 12 for the laundry 1 to be hung on. This supporting configuration is well-known in the art to which the specification pertains and thus the detailed description of the configuration will be omitted.

There may be formed in the cabinet a mechanism compartment 20 that accommodates the air supplying device 22 and the moisture supplying device 30 to selectively supply hot air and moisture to the accommodating space 12. The mechanism compartment 20 may be positioned under the accommodating space 12. The air supplying device 22 and the moisture supplying device 30 are positioned inside the mechanism compartment 20. Since the hot air and the steam supplied to the accommodating space 12 has an ascensional property, it is preferred that the mechanism compartment 20 is positioned in a lower portion of the cabinet 10 to supply the hot air and the steam upward. The numeral reference 15 that has not described in reference to FIG. 1 is an inner rear surface of the accommodating space 12 and the numeral reference 18 is the hot air supply hole through which the hot air is supplied to the accommodating space 12.

Figure 2:
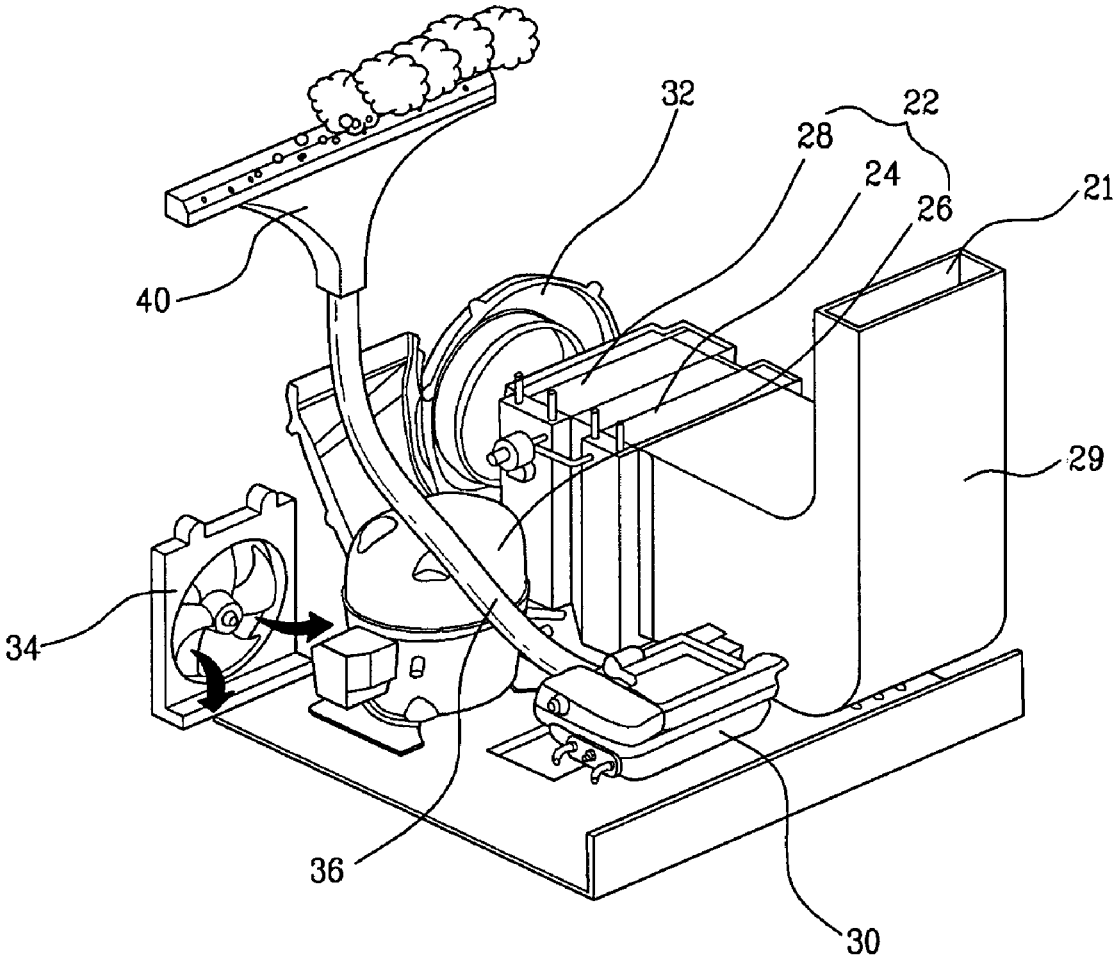
FIG. 2 is a perspective view schematically illustrating an inside of a mechanism compartment shown in FIG. 1.

FIG. 2 is a perspective view schematically illustrating a configuration of the mechanism compartment 20. FIG. 2 shows only elements of a heat pump 22 and the moisture supplying device 30 for convenience sake and a drain line for connecting the elements with each other is not shown in FIG. 2.

In reference to FIG. 2, the heat pump 22 may be provided in the mechanism compartment 20 as the air supplying device for supplying hot air to the accommodating space (12, see FIG. 1) and the steam generating device 30.

The heat pump 22 employed as the air supplying device is similar to a heat pump that is commonly used in an air conditioner and variations of it. That is, the heat pump 22 includes an evaporator 24, a compressor 26, a condenser 28 and an expansion valve (not shown) which refrigerant is circulated through. Using this configuration, air is dehumidified and heated. Specifically, a latent heat of ambient air is absorbed, with the refrigerant being evaporated and the air is cooled enough to condense and remove the moisture of the air. In addition, if the refrigerant passes through the compressor 26 and it is condensed at the condenser 28, the latent heat is emitted toward the ambient air and the ambient air is heated. As a result, the evaporator 24 and the condenser 28 are functioned as a heat exchanger, such that the air drawn into the mechanism compartment 20 is dehumidified and heated through the evaporator 24 and the condenser 28 and that the dehumidified and heated air is supplied to the accommodating space 12.

The air heated by the heat pump 22 has a relatively low temperature, compared with the air heated by a conventional heater. However, the air is dehumidified without using any dehumidifier. As a result, the air re-supplied to the accommodating space 12 by the heat pump 22 may be relatively 'low temperature dry air' (here, the expression 'low temperature' means heated air having a relatively lower temperature than conventional heated air, not substantially low temperature air). The air supplied by the heat pump 22 according to the embodiment has a low temperature, compared with the hot air of the conventional cloth treating apparatus, but it may be dehumidified without any dehumidifier. Accordingly, this embodiment makes it possible to dry and refresh the laundry efficiently with a simple structure.

More specifically, an air inlet 21 is formed at an upper front side of the mechanism compartment 20 such that air inside the accommodating space 12 is drawn into the mechanism compartment 20 there through. A duct 29 that connects the air inlet 21, the evaporator 24, the condenser 28 and a fan 32 each other may form a path for the air to flow along. The air drawn into the mechanism compartment 20 through the air inlet 21 is dehumidified and heated, passing the heat pump 22. The dehumidified/heated air is re-supplied to the accommodating space 12 by the fan 32.

Here, although not shown in the drawings, it is preferred that a filter is provided at the air inlet 21. If the filter is provided at the air inlet 21, foreign substances that might be contained in the air drawn into the mechanism compartment 20 may be filtered and only clean air may be supplied to the accommodating space 12.

On the other hand, the moisture supplying device 30 may be provided in the accommodating space 12 to selectively supply moisture to the accommodating space 12. Preferably, the moisture supplying device comprises a steam generating device for generating and supplying steam into the accommodating space 12. As the steam is supplied to the accommodating space 12 by the steam generating device 30, wrinkles and the like that might be generated on the laundry may be removed, by extension, the laundry may be sterilized by the steam or fabric of the laundry may rise. As a result, because of the steam, effects of sterilization and fabric refreshing may be obtained as well as the effect of wrinkle removal. A timing of steam spray may be adjustable and it is preferred that the steam is sprayed prior to the supply of the hot air performed by the heat pump 22. It is preferred that the hot air is supplied to dry the laundry after the high temperature steam is sprayed.

The steam generating device 30 includes a heater (not shown) for heating water such that steam is generated. The steam is supplied to the accommodating space 12. An external water tap may be used as a water source for supplying water to the steam generating device 30. Alternatively, a container-type water source may be provided in the mechanism compartment 20. It is preferred that the container-type water source is separable such that a user may separate the water source from the mechanism compartment 20 to fill up the water and that the user may install the water source again. In addition, the steam generated at the steam generating device 30 is supplied to the accommodating space 12 through a steam hose 36 and a steam nozzle 40. In this case, it is preferred that a length of the steam hose 36 is shorter as possible to prevent the temperature of the steam from falling or being condensed during the steam flow. If the mechanism compartment 20 is positioned under the accommodating space 12, the steam nozzle 40 may be provided in a top of the mechanism compartment 20, that is, the steam may be supplied through a bottom of the accommodating space 12.

A circulation fan 34 may be provided at a rear side of the mechanism compartment 20. External air is supplied to an inside of the mechanism compartment 20 through the fan circulation 34 such that an temperature inside the mechanism compartment 20 is prevented from rising too much when the heat pump 22 and the steam generating device 30 are put into operation.

Figure 3:
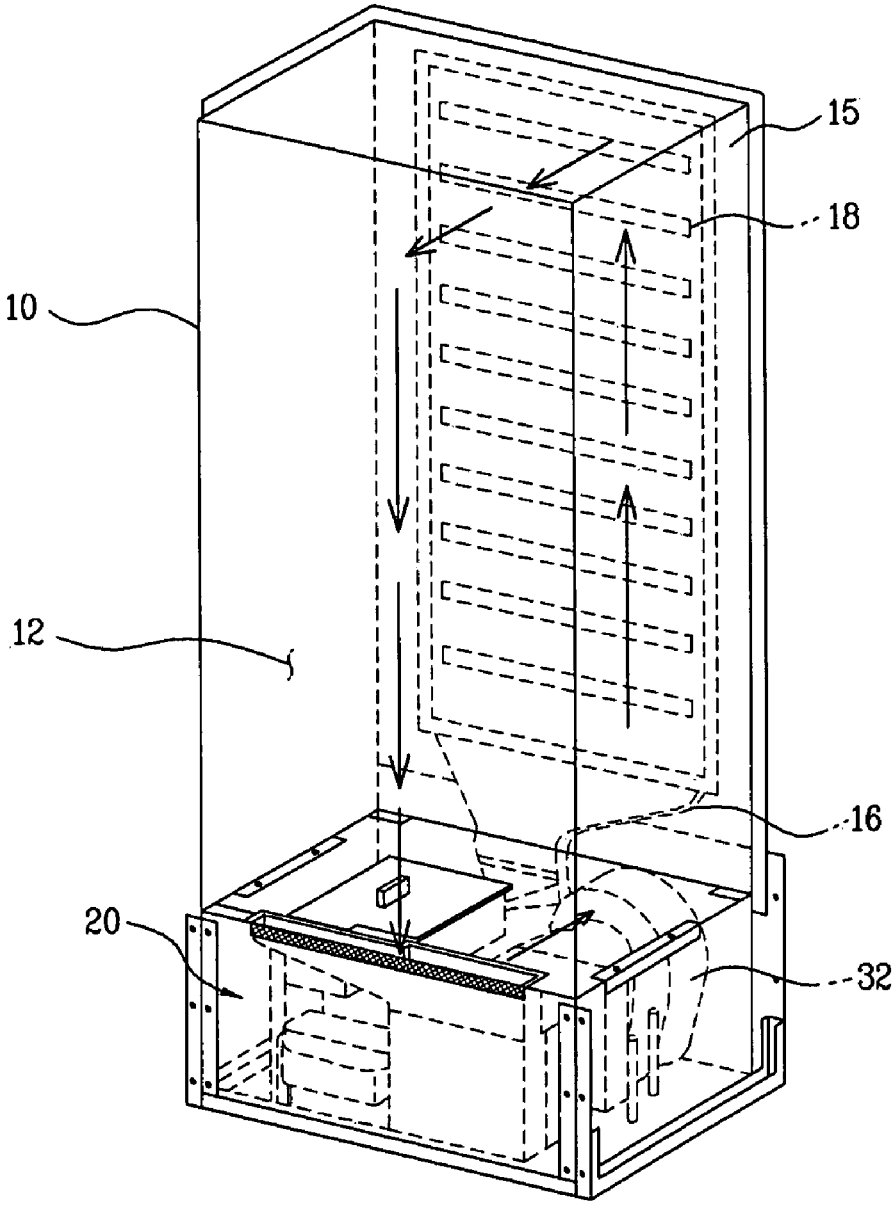
FIG. 3 is a perspective view illustrating an inner configuration of the cloth treating apparatus shown in FIG. 1.

FIG. 3 is a perspective view illustrating an inner configuration of the cloth treating apparatus according to the present invention.

In reference to FIG. 3, the hot air supply hole 18 is formed at the rear surface 15 of the mechanism compartment 20 and the hot air heated at the heat pump 22 is supplied to the accommodating space 12 through the hot air supply hole 18. However, such the hot air supply hole 18 is configured to be always open and because of that, if steam is sprayed into the accommodating space 12 by the steam generating device 30, there may be steam loss. That is, if the steam is sprayed into the accommodating space 12, the steam happens to flow into the duct 16 from the accommodating space 12 through the hot air supply hole 18. As a result, the effect of steam, for example, wrinkle removal, fabric refreshing and sterilization might deteriorate. Furthermore, bad smell may permeate through the duct 16 by the steam.

To solve the problem, according to this embodiment, an opening unit is further provided to selectively open and close the hot air supply hole 18. Specifically, if the steam is sprayed, the control unit (not shown) controls the opening unit to close the hot air supply hole 18. If the steam spraying is finished and the hot air is supplied, the control unit (not shown) controls the opening unit to close the hot air supply hole 18. As a result, if the steam is sprayed, the steam loss because of the air supply hole 18 may be prevented. Next, in reference to the corresponding drawings, an exemplary embodiment of the opening unit will be described in detail.

Figure 4:
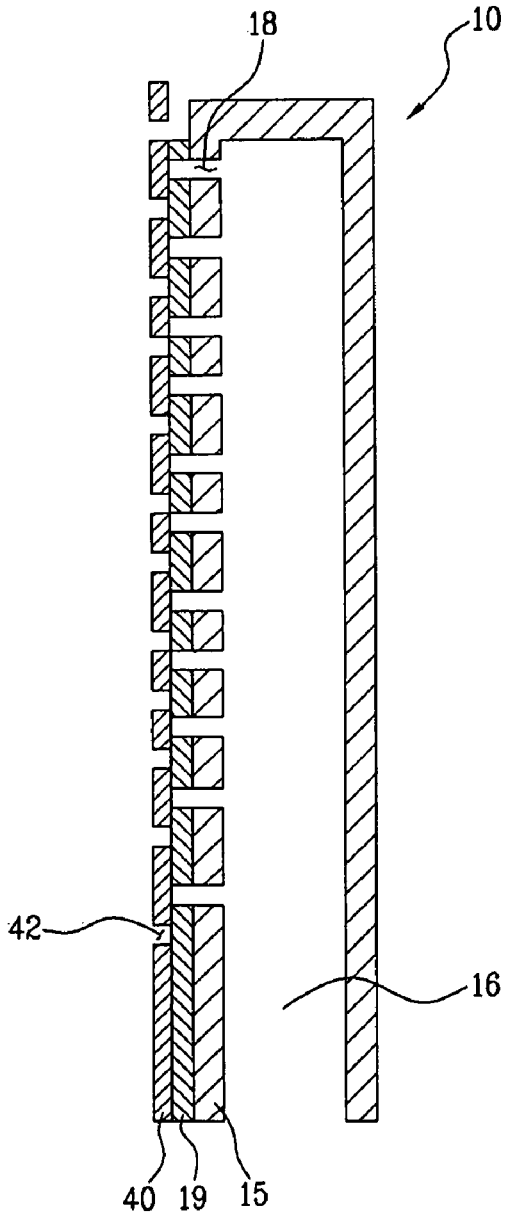
FIG. 4 is a sectional view illustrating that an opening unit according to an exemplary embodiment is positioned at a close position.
Figure 5:
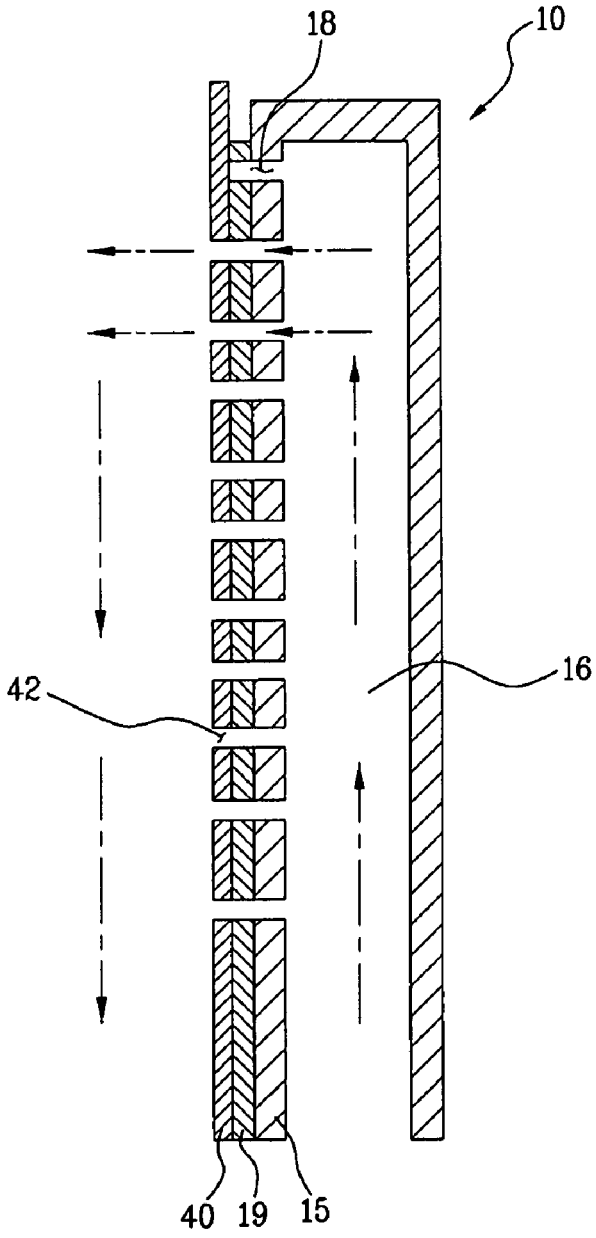
FIG. 5 is a sectional view illustrating that the opening unit is positioned at an open position.

FIGS. 4 and 5 are sectional views illustrating the opening unit of the cloth treating apparatus according to the embodiment. FIG. 4 shows that the hot air supply hole 18 is closed and FIG. 5 shows that the hot air supply hole 18 is open.

In reference to FIGS. 4 and 5, the opening unit according to this embodiment includes a movable plate 40 where an opening 42 is formed to correspond to the hot air supply hole 18. Specifically, the movable plate 40 is movable between an open position and a close position. Here, the open position is a position where the opening 42 is in communication with the hot air supply hole 18, and the close position is a position where the opening 42 is not communication with the hot air supply hole 18, namely, the communication between the opening 42 and the hot air supply hole 18 is closed. FIG. 4 shows that the movable plate 40 is positioned at the close position and FIG. 5 shows that the movable plate 40 is positioned at the open position. At this time, a middle plate 19 may be provided between the movable plate 20 and the rear surface 15 of the cabinet 10 to guide the motion of the movable plate 40 as well as to reduce friction.

The control of the opening unit performed by the control unit (not shown) will be described.

Firstly, if steam is sprayed into the accommodating space 12 by the steam generating device 30, the control unit (not shown) controls the movable plate 40 to be positioned at the close position as shown in FIG. 4. That is, the movable plate 40 is moved for the opening 42 not to correspond to the hot air supply hole 18. Accordingly, the accommodating space 12 is not communication with the duct 16. The steam sprayed into the accommodating space 12 is not drawn into the duct 16 only to prevent the loss of the steam.

As shown in FIG. 5, if the hot air is supplied by the heat pump 22, the control unit controls the movable plate 40 to be positioned at the open position as shown in FIG. 5. That is, the movable plate 40 is moved for the opening 42 to correspond to the hot air supply hole 18 of the cabinet 10. Accordingly, the accommodating space 12 is in communication with the duct 16 and the hot air passed by the fan 32 is supplied to the accommodating space 12 through the hot air supply hole 18 along the inside of the duct 16 as shown in FIG. 5.

This embodiment presents that the movable plate 40 is moved in a vertical direction but this is one of examples. The movable plate 40 may be configured to be movable in any directions to selectively open and close the hot air supply hole 18. For example, the movable plate may be configured to be movable along a horizontal direction or curving direction.

Figure 6:
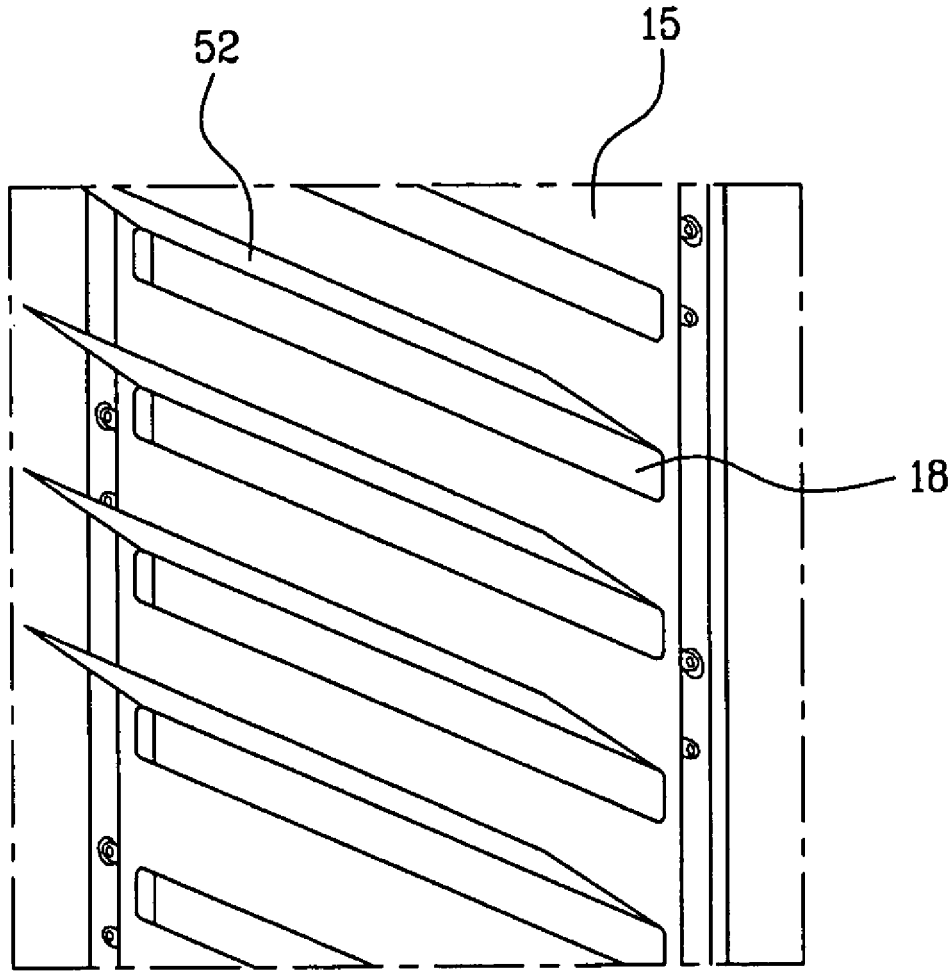
FIG. 6 is a perspective view illustrating an opening unit according to another embodiment.

FIG. 6 is a perspective view illustrating an opening unit according to another embodiment.

In reference to FIG. 6, an opening unit according to this embodiment includes at least one rotatable plate 52 that is rotatable with respect to the hot air supply hole 18 to a predetermined angle. Specifically, the rotatable plate 52 is rotatably connected with an upper portion of the hot air supply hole 18. The rotatable plate 52 may open and close the hot air supply hole 18, with rotating. If the rotatable plate 52 is provided in plural, the rotatable plates 52 may rotate separately and it is preferred that the rotatable plates 52 rotate in communication with each other, considering the convenience of its control and simplicity of its structure.

Figure 7:
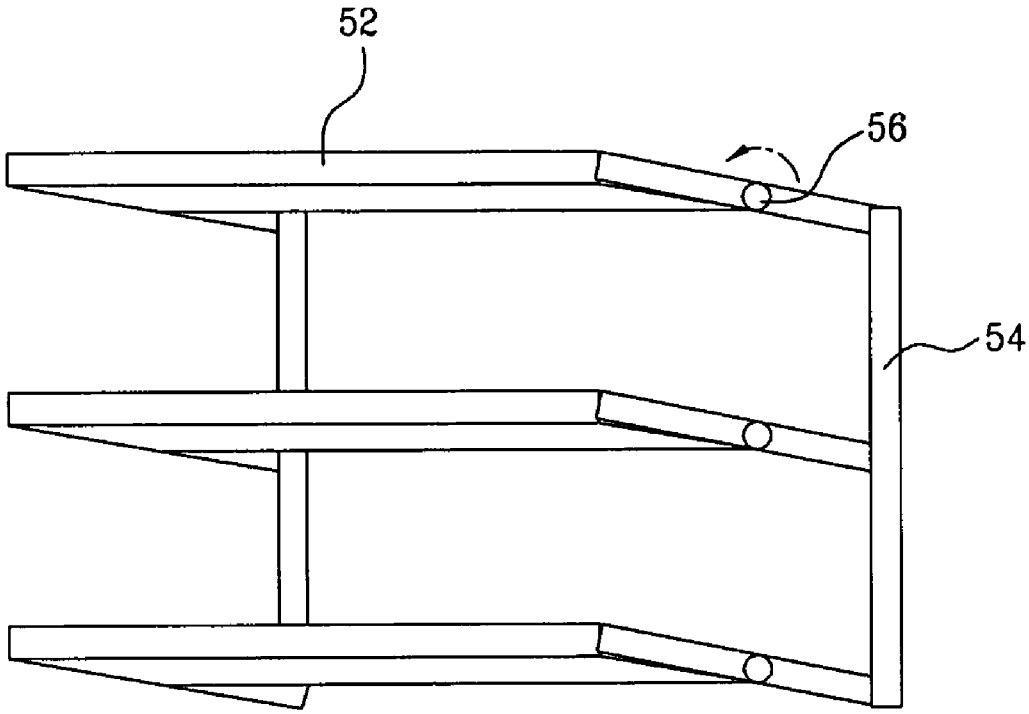
FIG. 7 is a perspective view illustrating a structure of communication if plural rotatable plates are provided in the opening unit shown in FIG. 6.

FIG. 7 is a perspective view illustrating a structure of the rotatable plates 52 that rotate in communication with each other, if the plural rotatable plates are provided. FIG. 7 shows only the rotatable plates 52 and an operation bar 54 for convenience sake.

In reference to FIG. 7, if the plural rotatable plates 52 are provided, each of the rotatable plates 52 is rotatably connected with the upper portion of the hot air supply hole (18, see FIG. 6) by a rotation shaft 56. Here, a rear end of each rotatable plate 52 is connected to the operation bar 54. In this case, the operation bar 54 may be positioned at the inner rear surface 15 of the accommodating space 12. If the operation bar 54 moves upward or downward in a vertical direction under the control of the control unit, the plural rotatable plates rotates in communication with each other.

Furthermore, if the upward or downward motion distance of the operation bar 54 is adjusted, the rotation angle of the rotatable plate 52 may be adjusted. That is, the rotatable plate 52 is rotated in proportion to the upward or downward motion distance of the operation bar 54. As a result, the adjustment of the upward or downward motion distance makes it possible to adjust the rotation angle of the rotatable plate 52. The rotatable plate 52 is rotated in a direction toward an inside of the accommodating space 12. In addition, the adjustment of the rotation angle of the rotatable plate 52 makes it possible to guide the direction of the supplied hot air or to adjust the amount of the hot air.

As mentioned above, the structure in that the plural rotatable plates 52 rotate in communication with each other is an example. The present invention is not limited to the above structure and it may be embodied differently.

Figure 8:
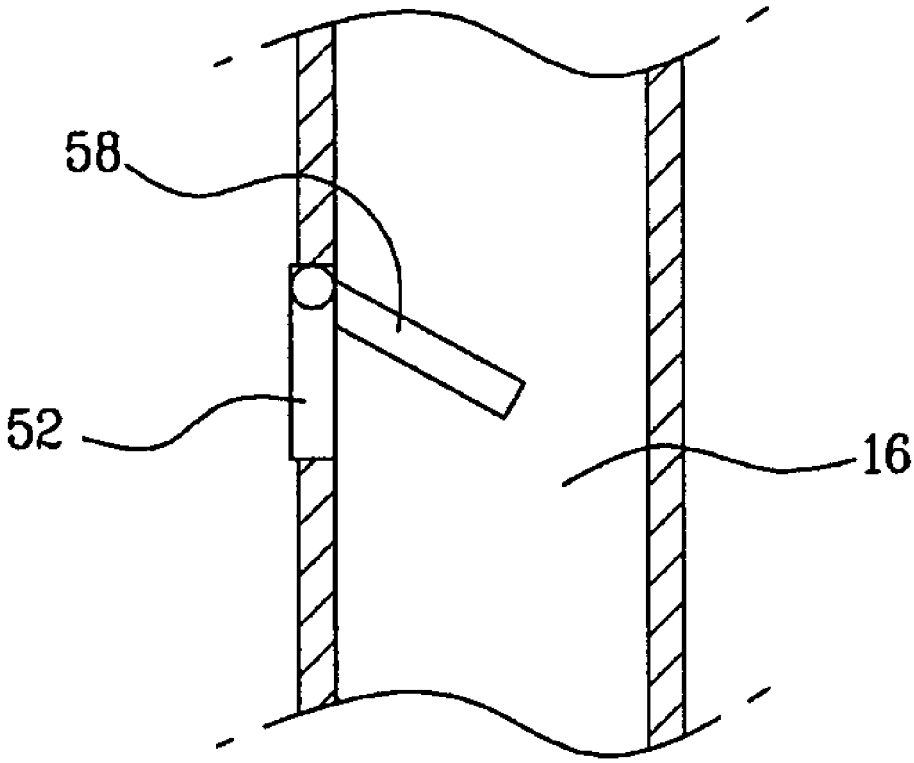
FIG. 8 is a sectional view illustrating that the opening unit of FIG. 6 is closed.
Figure 9:
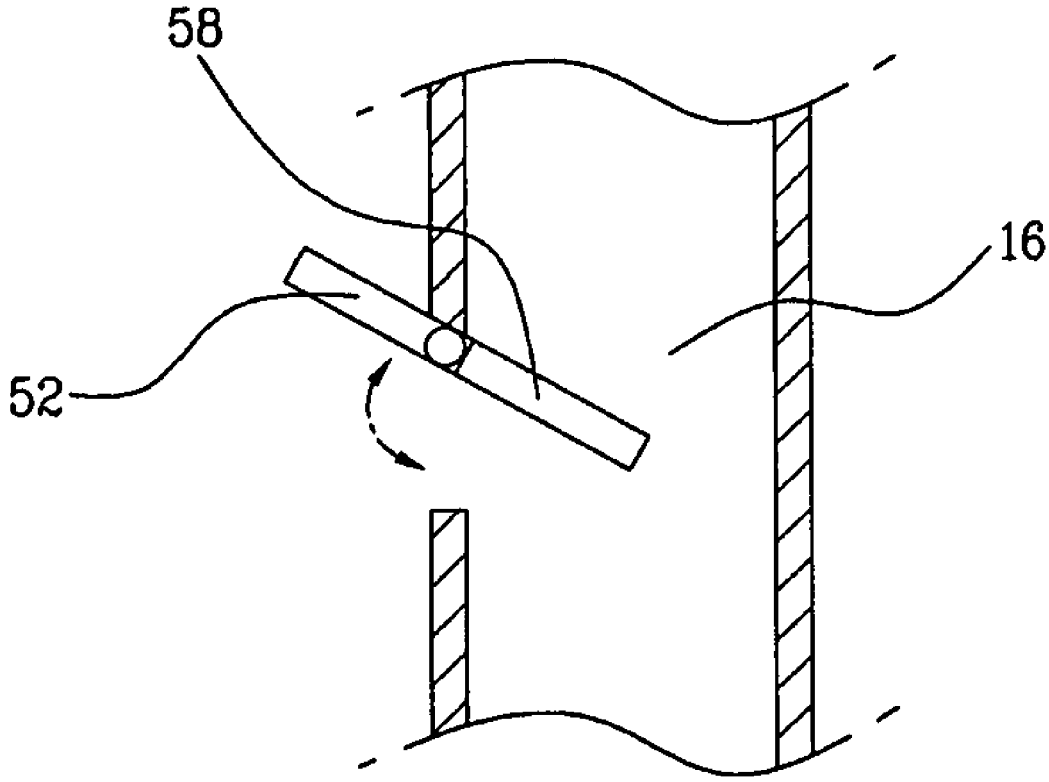
FIG. 9 is a sectional view illustrating that the opening unit of FIG. 6 is opened.

FIGS. 8 and 9 illustrate that the hot air supply hole 18 is closed and opened by the rotation of the rotatable plate 52, respectively. Such the rotation is performed by the upward and downward motion of the operation bar (54, see FIG. 7) and the detailed description of the rotation will be omitted. A numeral reference 58 not described in reference to FIGS. 8 and 9 is a fixed guide member. The fixed guide member 58 is projected toward a rear surface of the hot air supply hole 18 to guide the hot air to flow upward to the hot air supply hole 18.

Next, an operation of the cloth treating apparatus having the above configuration will be described.

If the cloth treating apparatus is put into operation, the water supply source supplies water to the steam generating device 30 and steam is generated to be sprayed into the accommodating space 12. Because of that, the effects of the wrinkle removal, fabric refreshing and sterilization may be obtained. In this case, the control unit (not shown) controls the opening unit to close the hot air supply hole 18 such that the steam supplied to the accommodating space 12 may not be lost through the hot air supply hole 18.

Once the steam is sprayed for a predetermined time period, the hot air is supplied by the heat pump 22. The control unit controls the opening unit to open the hot air supply hole 18 and the heat pump 22 supplies the hot air through the hot air supply hole 18. That is, the heat pump 22 dehumidifies and heats air by using the evaporator 24 and the condenser 28 and then it re-supplies the dehumidified/heated air to the accommodating space 12.

If the drying of the laundry is complete by the hot air, the supply of the hot air is stopped and the refreshing is finished.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cloth treating apparatus comprising:

a cabinet comprising an accommodating space to accommodate laundry and a mechanism compartment positioned under the accommodating space;

an air supplying device to heat air and supply hot air to the accommodating space;

an opening unit which selectively opens and closes at least one hot air supply hole through which the hot air supplied by the air supplying device is drawn into the accommodating space; and a control unit which controls the air supplying device and the opening unit;

a moisture supplying device to selectively supply moisture into the accommodating space, wherein the mechanism compartment accommodates the air supplying device and the moisture supplying device.

2. The cloth treating apparatus of claim 1, the moisture supplying device comprises a steam generating device to generate and supply steam into the accommodating space.

3. The cloth treating apparatus of claim 2, wherein the control unit controls the opening unit to close the hot air supply hole if the steam is sprayed into the accommodating space by the steam generating device.

4. The cloth treating apparatus of claim 3, wherein the control unit controls the opening unit to open the air supplying device if the hot air is supplied to the accommodating space by the air supplying device.

5. The cloth treating apparatus of claim 3, wherein the opening unit comprises, a movable plate including at least one opening corresponding to the hot air supply hole, the movable plate which moves between an open position where the opening is in communication with the hot air supply hole and a close position where the communication between the opening and the hot air supply hole is closed.

6. The cloth treating apparatus of claim 4, wherein the opening unit comprises at least one rotatable plate rotatably installed at the hot air supply hole.

7. The cloth treating apparatus of claim 6, wherein a rotation angle of the rotatable plate is adjustable.

8. The cloth treating apparatus of claim 7, wherein the rotatable plate is rotated toward an inside of the accommodating space to guide a direction of the hot air drawn into the accommodating space through the hot air supply hole.

9. The cloth treating apparatus of claim 6, wherein if the rotatable plate is provided in plural, the plural rotatable plates are rotated in communication with each other.

10. The cloth treating apparatus of claim 9, wherein the plural rotatable plates are rotated by a single operation bar, in communication with each other.

11. The cloth treating apparatus of claim 6, further comprising:

a fixed guide member projected toward a rear surface of the hot air supply hole to guide the hot air to the accommodating space.

* * * * *